US005624093A

United States Patent [19]

Gemmell

[11] Patent Number: 5,624,093

[45] Date of Patent: Apr. 29, 1997

[54] CLAMPING PAINT TRAY ASSEMBLY WITH HOLDING APPARATUS

[76] Inventor: R. Wayne Gemmell, 2520 Pasqua Street, Regina, Saskatchewan, Canada, S4S 0M2

[21] Appl. No.: 463,712

[22] Filed: Jun. 5, 1995

[51] Int. Cl.[6] ..... E04G 5/06

[52] U.S. Cl. ..... 248/231.41; 248/210; 248/226.11; 248/238; 220/570; 220/759; 220/760

[58] Field of Search ..... 248/206.5, 210, 248/226.11, 231.41, 231.51, 238; 220/402, 410, 570, 759, 760; 15/257.05, 257.06

[56] References Cited

U.S. PATENT DOCUMENTS

| | | | |
|---|---|---|---|
| 2,650,787 | 9/1953 | Valentine | 248/231.41 X |
| 2,707,089 | 4/1955 | Jackson | 248/231.51 X |
| 2,921,330 | 1/1960 | Prytikin | 15/257.05 |
| 3,941,341 | 3/1976 | Brogdon, Jr. | 248/210 X |
| 3,947,135 | 3/1976 | Hawk | 15/257.06 X |
| 4,310,134 | 1/1982 | Schopp et al. | 248/210 |
| 4,395,013 | 7/1983 | Wissinger | 248/210 X |
| 4,653,713 | 3/1987 | Hamilton | 248/238 |
| 5,052,581 | 10/1991 | Christ et al. | 15/257.06 X |
| 5,083,733 | 1/1992 | Marino et al. | 248/206.5 X |
| 5,265,929 | 11/1993 | Pelham | 248/231.41 X |
| 5,511,279 | 4/1996 | Ippolito | 15/257.06 |

*Primary Examiner*—Leslie A. Braun
*Assistant Examiner*—Richard M. Smith

[57] ABSTRACT

A paint tray assembly includes a ladder clamp to secure the tray to a ladder or scaffold and magnetic holder and swing-away rod providing mechanisms for retaining paint brushes in the tray. A detachable handle attaches to the tray to permit relocation of the tray from one area to another minimizing the possibility of unwanted spillage of paint from the tray.

5 Claims, 9 Drawing Sheets

CLAMPING PAINT TRAY ASSEMBLY WITH HOLDING APPARATUS

FIELD INVENTION

This application relates to liquid container apparatus and more particularly to an equipment combination that is used to contain a supply of liquid for application.

BACKGROUND OF INVENTION

In an attempt to make objects or structures more pleasing to the eye or to protect them from the elements, various types of surfaces have been applied in various ways. One common solution to the age old problem is the application of a coating of paint by a spray, roller, brush or other means. Some problems that always arise with painting by roller and brush is that the tray holding the paint makes for unwanted spillage of paint during the painting process in many different ways. For example, the brush falls out of the tray or becomes covered in paint should it fall into the tray which paint is subsequently transferred to the users hands causing disruption to the painting process.

Similarly, the roller tray itself is often mounted on a ladder where it can be easily dislodged through use or simply inadvertent bumping of the ladder, causing the tray to fall down spilling and splashing the paint.

To obviate the problems to a considerable degree, there is herein described a combination that will mount a paint brush in the tray; that will permit easy transport of the tray with or without paint; and apparatus to securely retain the paint tray to a ladder to prevent its unwanted or inadvertent removal or dislodgement from the ladder.

SUMMARY OF THE INVENTION

The present invention provides a novel and unique assembly to be used by a novice or commercial craftsman in the application of liquid coating material.

In one of its aspects, the invention provides: a paint tray assembly comprising a base having radiused corners extending around the bottom perimeter thereof, a paint holding container supported by said base and means for clamping said paint tray assembly to an object.

In another of its aspects, the invention provides a paint tray assembly comprising a base having radiused corners extending around the bottom perimeter thereof, a paint holding container supported by said base, means for clamping said base to an object, at least one magnet whereby a paint brush may be magnetically retained with said paint holding container.

In one configuration, the paint tray clamp has a clamp rod mountable in said base extending downwardly therefrom, a clamp jaw slideably engaging said clamp rod, a locking collar having a clamping handle extending therefrom and pivotably engaging said clamp jaw whereby closing said clamp handle will lock said locking collar to said clamp rod and cause the clamp jaw to compressably engage an object below said base.

In another configuration, the paint tray clamp has a clamp element mountable in said base and extending downwardly therefrom, a clamp jaw including handle means depending therefrom pivotably attached to said first clamp element; spring means engaging said first clamp element and said clamp jaw to urge the clamp jaw toward said base causing the clamp jaw to compressably engage an object below said base.

In view of the above summary, it is readily apparent that the primary object of the present invention is to provide a system or assembly that is convenient to use and avoids financial loss due to unwanted spillage of paint materials.

A further object of this invention is to provide a paint tray that can be easily located from one location to another without spilling any paint.

The preferred embodiment of the invention together with variations thereof and a description of the manner of operation the invention will now be described with reference to the drawings in which:

BRIEF DESCRIPTION OF THE DRAWINGS

FIGS. 1*a*, 1*b* are a perspective views of an alternate embodiments of the lid of FIG. 1.

DETAILED DESCRIPTION OF THE INVENTION

Figure 1:
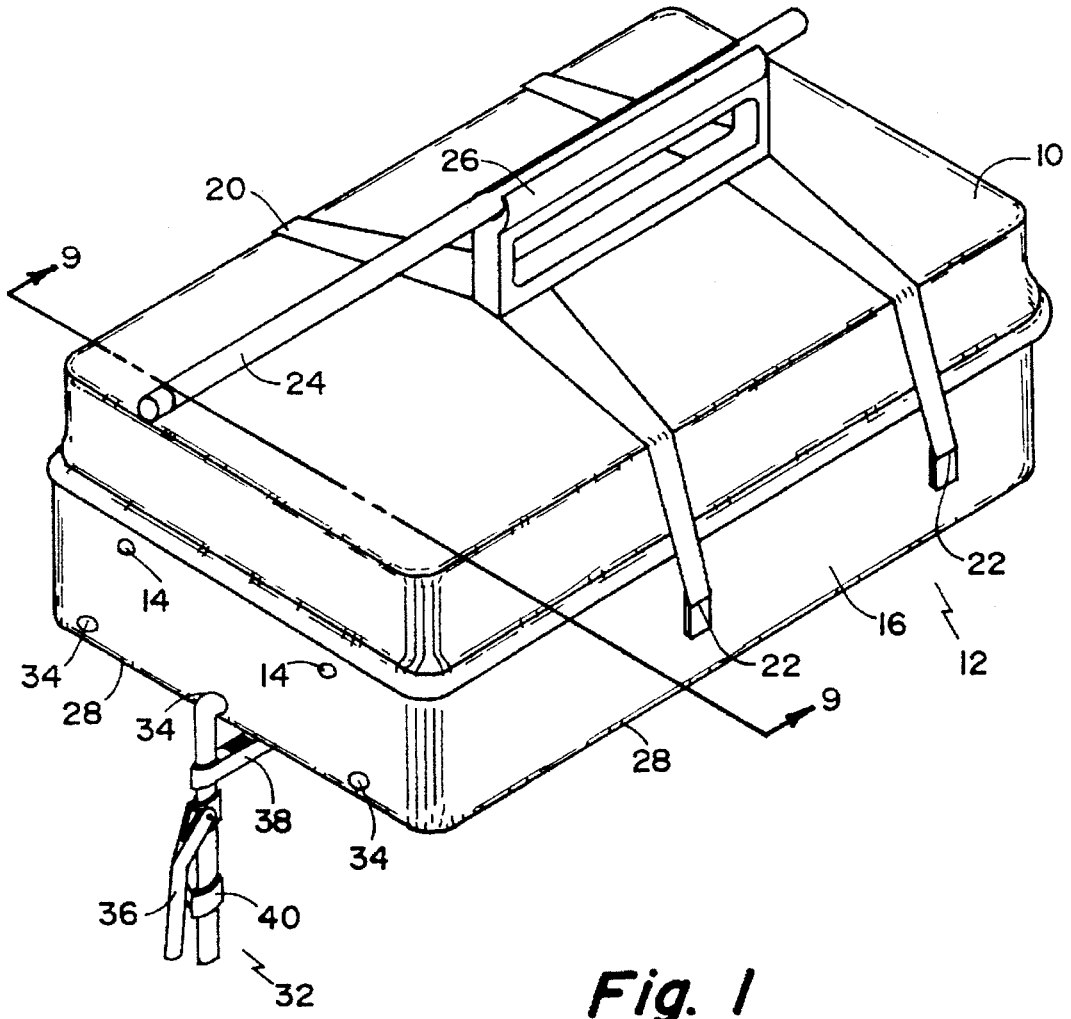
FIG. 1 is a perspective view of a paint tray assembly in accordance with the first embodiment of the invention.

Referring now to FIG. 1, there is a shown a perspective view of a first embodiment of the paint tray. The paint tray assembly 12 is covered by an optional cover 10 which sealingly engages a paint tray assembly 12. The optional cover 10, maybe interlockingly engaged with the perimeter of paint tray assembly 12 to provide a sealed interior chamber. The manner of sealing cover 10 to paint tray assembly 12 is not material and may include the types of seals as is commonly found in household storage containers. Alternately, the cover 10 maybe positively engaged by means of latches (such as luggage or tool box clasps) that extend between the tray assembly 12 and the cover 10 to release the cover 10 from the tray assembly 12. Alternately, internal latches can be provided that release upon manipulation of release buttons 14. Further description of the manner of seating is given in my co-pending U.S. patent application Ser. No. 08/135,537 filed Oct. 14, 1995.

As will be understood with reference to subsequent figures of the invention, tray assembly 12 has an interior paint holding container 44 that extends downwardly and provides an inclined rolling surface. As a result, a base 16 is provided which ensures that the paint tray assembly 12 rests on a flat surface horizontally due to the alignment provided by base 16. Moreover, providing a separate base 16 creates a small storage area interior to the tray assembly 12 for storage of roller sleeves, brushes, tapes and other painting accessories. It will, naturally be understood that paint tray assembly 12 can be a unitary construction comprising both paint holding container 44 and base 16 as a single unit which, of course, would not have the small storage area as the interior hollow space in such a paint tray assembly would be inaccesable. Base 16 is secured to paint holding container 44 through suitable engaging means such as interfitting surfaces as are described in the co-pending Canadian Patent Application referred to earlier. An example is given herein in FIG. 9*a*.

The bottom perimeter of base 16 is provided with a radiused corner 28, which may be seen more clearly in many of the subsequent figures of the drawings. The radiused corner is very useful in permitting the user of the paint tray to slide or drag it along to relocate it from one location to another when resting on a flat or substantially flat surface such as a floor or counter top. Any small debris or obstruction, such as nails, screws, shavings, sawdust and the like or or cracks or uneveness in the surface supporting the paint or tray assembly or folds or creases in a paint drop sheet can be overcome by provision of such a radiused corner without the tray binding or colliding with the obstruction or debris when it is being slid accross the surface. This is a handy feature which minimizes accidental spillage of paint.

To permit the user to pick up the tray to relocate the paint tray assembly from one location to another, a removable handle 20 is provided which has engaging snaps 22 that permit the handle to be attached onto tray assembly 12 when the handle is being used to transport the tray from one area to another. During the painting process, handle 20 may be removed from the tray assembly 12 to permit the paint to be removed from the paint holding container 44 forming the interior of the paint tray assembly 12. The handle 20 is configured to permit painting to be carried out even when mounted on paint tray assembly 12. The handle is preferably attached to the base 16 to permit the handle to be mounted on the paint tray independently of the cover 10.

An extension pole 24 receiving storage slot is formed by parallel extending pole grips 26 extending from the upper portion of the hand grip of removeable handle 20. The pole grips 26 are for holding an extension pole which is commonly used to extend the reach of a paint roller by threading or coupling the extension pole 24 onto the handle of a commonly available paint roller (not shown). Extension pole 24 is in this manner provided with a simple and convenient place for storage when the tray is not is use. Moreover, placing the extension pole 24 in the handle permits all paint equipment to be moved from one location to the next in a compact single arrangement or kit. As will be appreciated, extension pole 24 may be a telescoping type metal pole or fibreglass pole or a simple one-piece wooden extension pole.

Shown extending downwardly from base 16 is a ladder clamp 32 which is receivably engaged by base 16 using a suitable means such as a receiving bore 34 to receive the clamp 32 therein. The clamp is provided with a handle 36 that can be operated to cause clamp jaw 38 to move upwardly toward base 16 to compressably engage a top ladder step or shelf or scaffolding plank therebetween to securely retain the paint tray assembly to the ladder. Various thickness' of objects may be clamped between clamp jaw 38 and tray 16 as the clamp is provided with a moveable locking collar 40 which provides the base fulcrum for the clamping action and the clamp is closed by urging handle 36 downwardly toward the clamp 32. Other forms of clamp may be used as will be explained in more detail with reference to subsequent figures herein. There are preferably three receiving bores provided in tray assembly 12 at each end of the tray which allow either end of the tray to be clamped and to allow use of a single clamp as shown in FIG. 1 or a clamp pair as shown in FIG. 2.

Figure 1A:
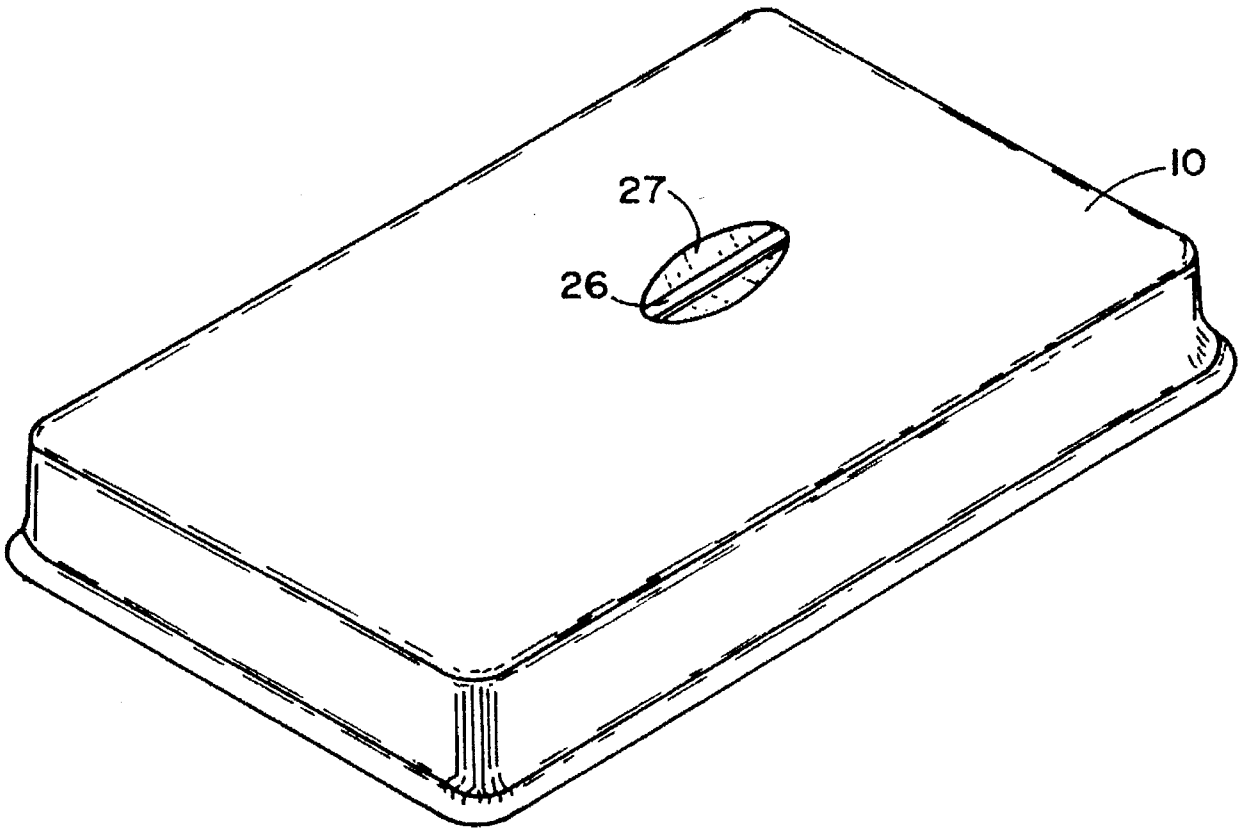

Referring now to FIG. 1*a* there is shown an alternate embodiment of a covering lid 10 for the paint tray. In this embodiment, a handle 26 is positioned in the lid. Access to the handle is permitted through finger recesses 27 which extend downwardly below the handle into and below the flat surface of lid 10. Handle 26 is dimensioned to be generally flat and co-planar with the top surface of lid 10 to permit paint trays to be stacked one on top of the other when on a shelf, as for example, when they are offered for sale to the public. For convenience, handle 26 may be provided with extensions (not shown) that slideably extend into the interior portion of lid 10 to permit the handle to be extended upwardly from lid 10 when grasped by someone picking up the paint tray kit using handle 26.

Referring now to FIG. 1*b* there is shown an alternate embodiment of a covering lid 10 for the paint tray. In this embodiment, a handle 26 is positioned in the lid. The handle is rotateably mounted on the lid to permit it to swing upwardly perpendicular to the planar upper surface of the lid to enable grasping of the handle to pick up the paint tray assembly. When not in use, handle 26 rotates back into the receiving slot providing a generally planar upper surface permitting paint trays to be stacked as was noted with reference to the description in relation to FIG. 1*a*.

Figure 2:
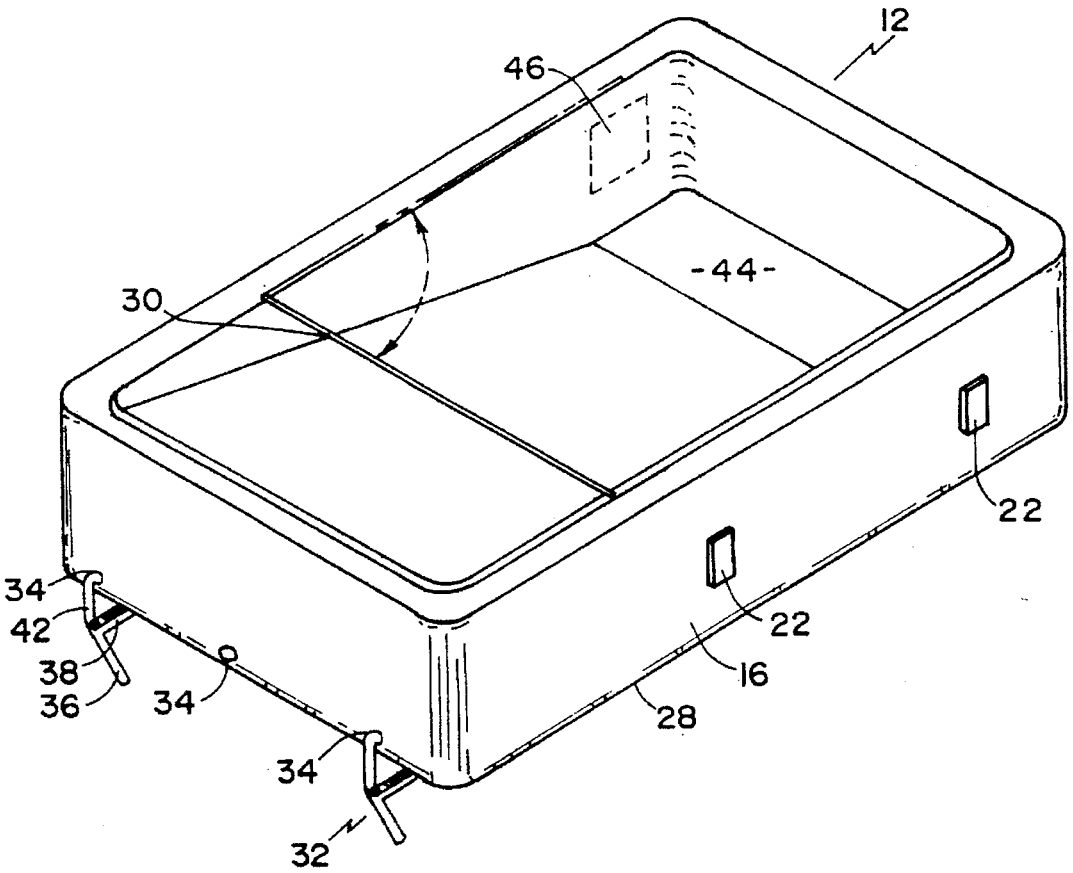
FIG. 2 is a perspective view of an alternate embodiment of a paint tray assembly.

Referring now to FIG. 2 there is shown a perspective view of an alternate embodiment of a paint tray assembly in accordance with the present invention. The paint tray assembly 12 of FIG. 2 comprises a two-part construction paint tray including a tray container 44 engaged by the base 16 of the paint tray. Provided at the near end of the paint tray are a pair of clamps 32 which are different in construction than those clamps described with reference to FIG. 1. The clamps are spring loaded (spring not shown) having an upper clamp body 42 which is received in a corresponding bore 34 provided in the base 16. The clamp jaw 38 is hingedly attached to the upper clamp element 42 and provided with a handle 36 descending from the clamp jaw. When the handle 36 is pulled away from the tray assembly 12, the jaw 38 opens. Upon release of handle 36, the spring (hidden behind the clamp elements) urges the handle 36 and clamp jaw 38 inwardly and upwardly toward the tray thereby causing any object positioned between the tray assembly 12 and the clamp jaw 38 to be securely held there between. The removable handle 20 (not shown for clarity) may be mounted on the tray by means of the engaging snaps or latches 22 as shown. Provided in the space between tray container 44 and the exterior skirting base 16 is shown in hidden outline a magnet 46 which may advantageously employed to hold a paint brush placed vertically adjacent to the wall within the tray container 44. As may be appreciated, the magnet 46 may be provided on either side of the tray container 44 to permit the brush to be held on either side thereof.

Attached to the top portion of one side of tray assembly 12 is a storage rod 30 which is rotatable from stand-by position along the side of the tray shown in silhouette to a working position shown in solid outline accross the interior space of the paint tray assembly 12 to be engaged in a receiving slot formed on the top portion of the tray side opposite and over the inclined rolling out surface of the tray. The swing of storage rod from a standby position to the working position is shown by means of the double-headed arrow. The storage rod 30 is a rust-proof metal, aluminium or plastic rod which provides a convenient resting place for a paint roller handle or paint brush (not shown) to keep it up and away from the paint.

Figure 3:
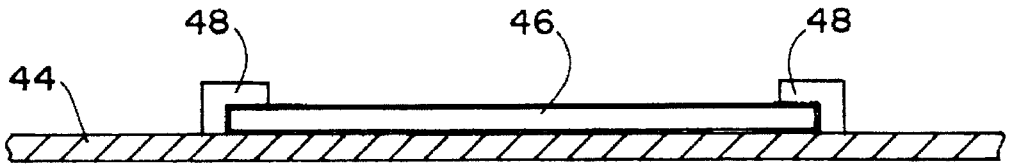
FIG. 3 is an enlarged bottom plan view of paint tray showing magnet mounting pocket.

Referring now to FIG. 3 there is shown an enlarged bottom plan view of the paint tray showing the magnet 46 mounted in a receiving pocket which is formed from channels 48 that extend around three sides of the perimeter of the magnet on the opposite side of that portion of the paint tray forming the tray container 44. In this way, magnet 46 may be inserted into the receiving pocket.

Figure 4:
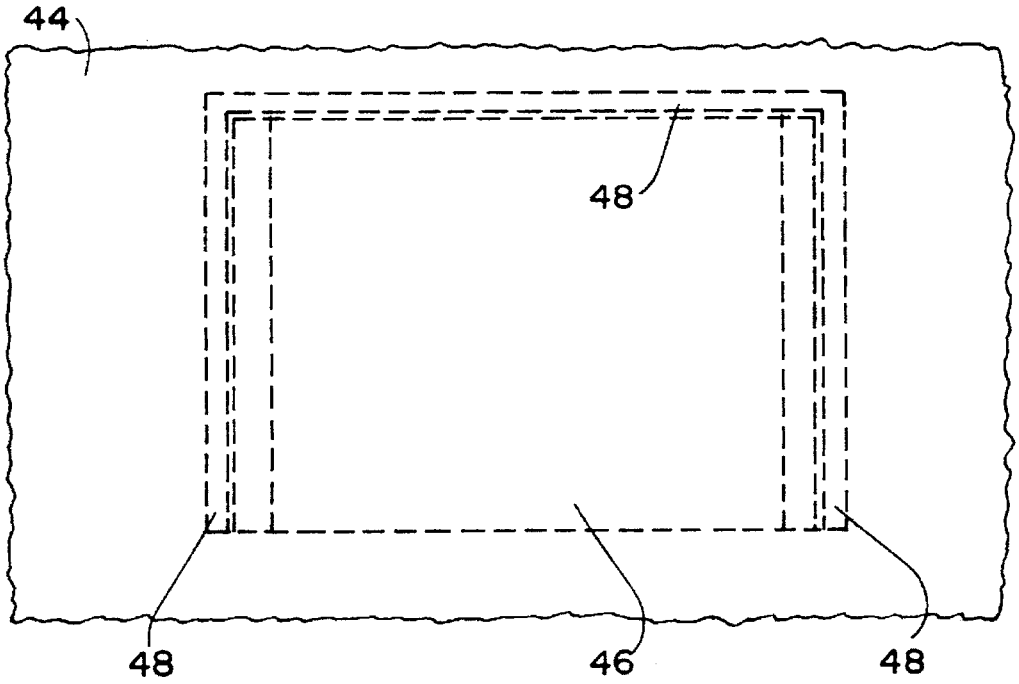
FIG. 4 is an enlarged plan view of magnet.

Referring now to FIG. 4 there is shown a enlarged plan view of the magnet 46 held in place by means of the channels 48 described with reference to FIG. 3.

Figure 5:
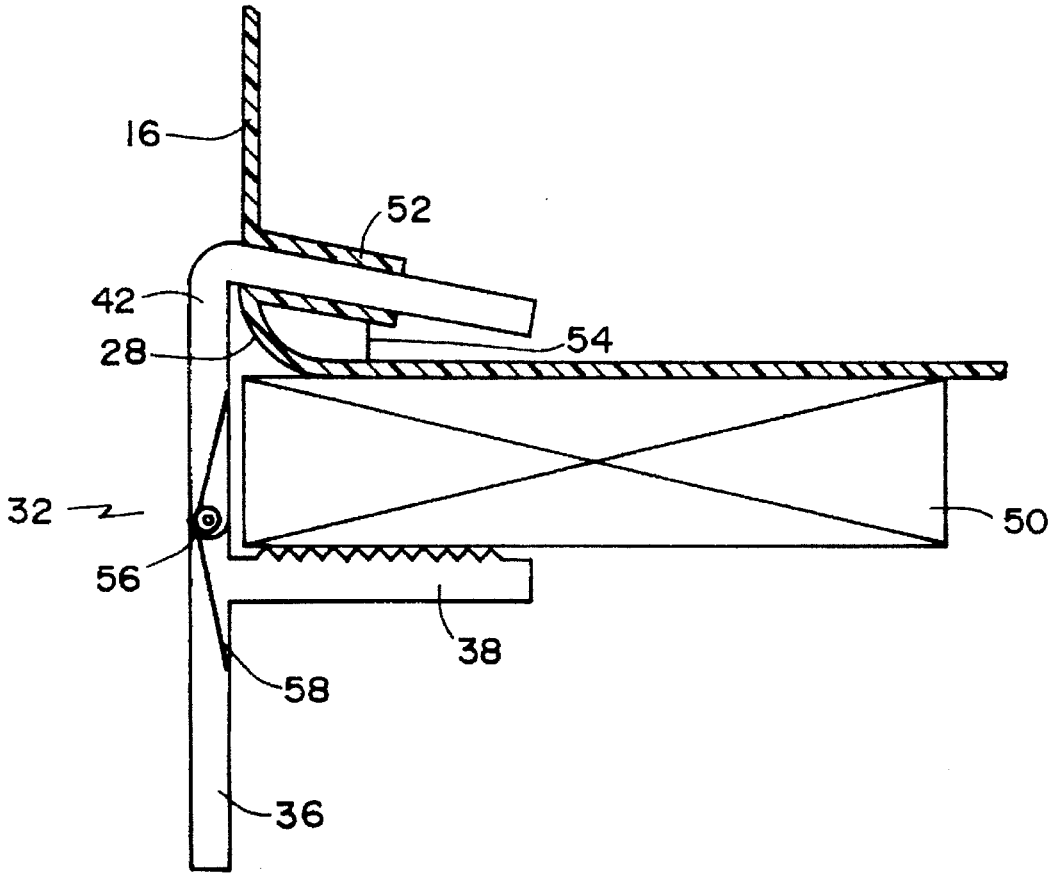
FIG. 5 is an enlarged partial section showing ladder clamp clamping a solid object.

Referring now to FIG. 5 there is shown an enlarged partial section of the base 16 having mounted therein the ladder clamp of FIG. 2 showing ladder clamp 32 engaging a solid object 50 which could be the top wooden (or fiberglass) stair or shelf of a ladder or plank of a scaffold. The base 16 is provided with a clamp receiving sleeve 52 which is shown with optional webbing 54 to strengthen the clamp receiving sleeve 52 to the bottom portion of the base 16 as shown. Upper clamp element 42 is provided with a downwardly inclined top portion that is slideably received by the clamp receiving sleeve 52 to prevent clamp 32 from disengaging from the paint tray base 16 when an object is being clamped by the clamp. The lower clamp jaw 38 and clamp handle 36 are single piece orthoganal construction attached to the upper clamp by means of clamp hinge 56. Clamp jaw 38 is urged toward the object to be clamped (i.e. step 50) by means of a clamp spring 58 which is wound around hinge 56 and one portion of which engages the upper clamp 42 the other portion of which engages the handle 36 and unitary jaw 38.

A cross-section of the radiused corner 28 is clearly shown here which was described in relation to FIG. 1. As will be recalled, the radiused corner 28 enables the paint tray to slide or be dragged over obstructions more readily.

Figure 6:
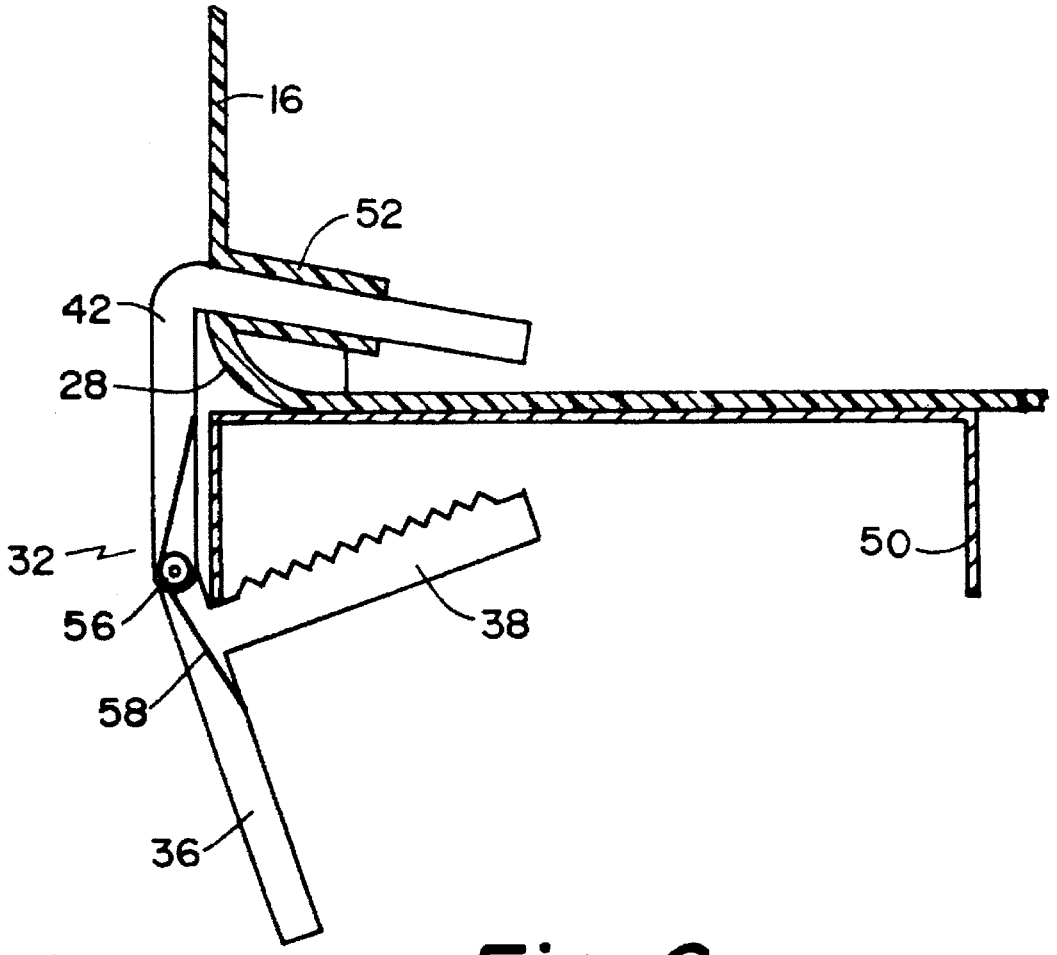
FIG. 6 is an enlarged partial section showing ladder clamp clamping a channel element.

Referring now to FIG. 6 there is shown an enlarged partial section of the paint tray depicting a ladder clamp 32 clamping a channel element. The clamp operates in the exact same fashion as described with reference to FIG. 5. The ladder clamp in this instance grippingly engages a channel element 50 which is commonly found in ladders constructed of metal, such as aluminium, where each step or shelf on the ladder or plank of a scaffold is constructed from channel elements having an open underside.

Figure 7:
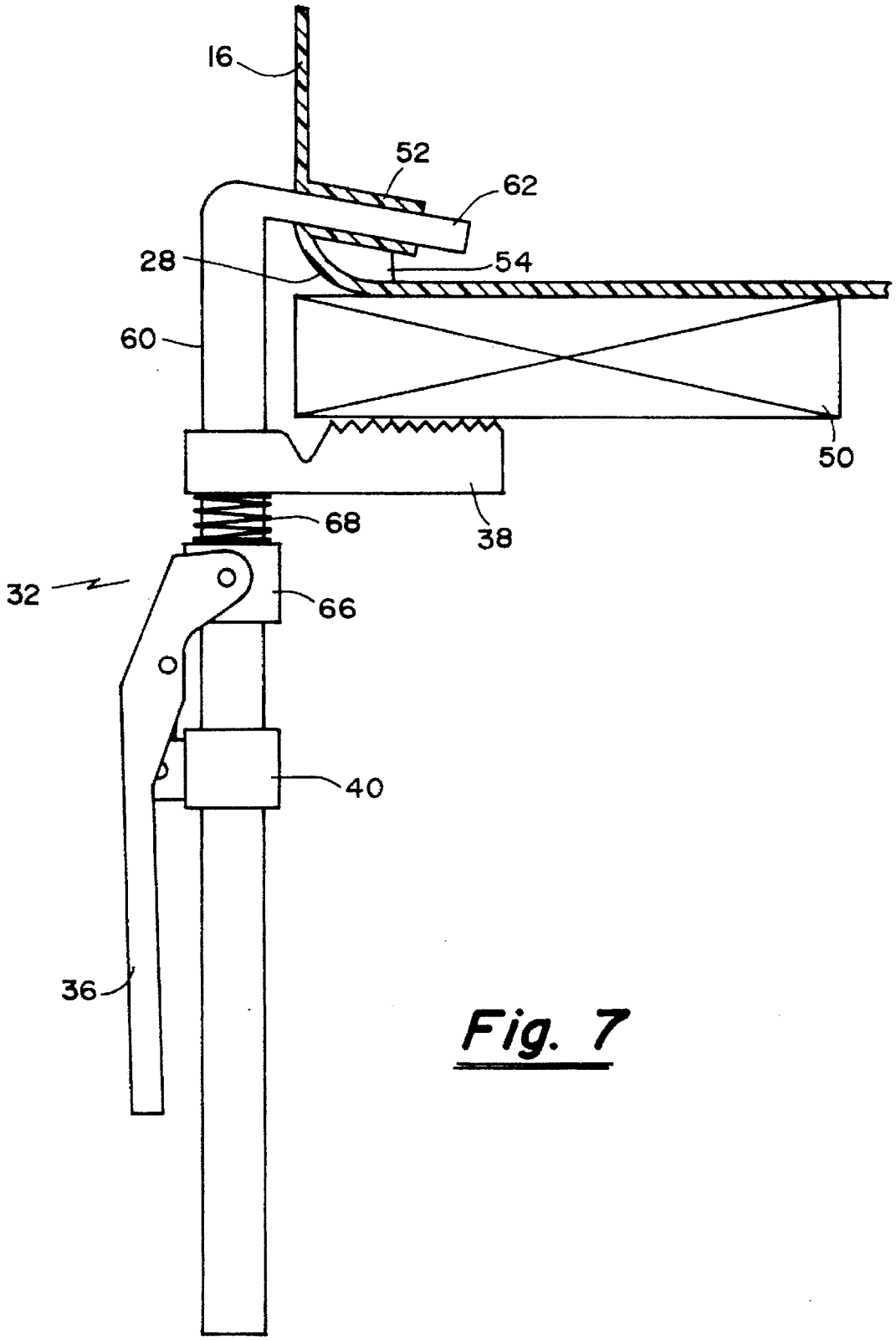
FIG. 7 is an enlarged partial section showing alternate embodiment of ladder clamp clamping a solid object.

Referring now to FIG. 7 there is shown an enlarged partial section of the paint tray showing an alternate embodiment of the ladder clamp (as shown in FIG. 1) clamping a solid object. A wood ladder top stair tread or scaffold plank 50 is shown engaged between clamp lower jaw 38 and the base 16 of the paint tray. The clamp is formed from an elongate pipe 16 which is shown having a clamp rod 62 extending outwardly and downwardly into the clamp receiving sleeve 52 of the base 16. Again, the downward inclination of the clamp rod 62 is to ensure that the clamp does not slide out of the paint tray assembly when it is clamped to a ladder or scaffold and the like. The clamp pipe 60 can equally easily be constructed of a cylindrical solid core rod. The clamp is provided with a lower locking collar 40 which slides up and down rod 60 until the clamp handle 36 is depressed. Depressing clamp handle 36 causes the lower locking collar 40 to tend to rotate about clamp pipe 60 causing it to bind or lock into the position where it is when the handle 36 is depressed thereby urging upper clamp collar 66 upwardly compressing spring 68 thereby causing the lower jaw 38 to slide upwardly and compressably engage the ladder step 50.

Figure 8:
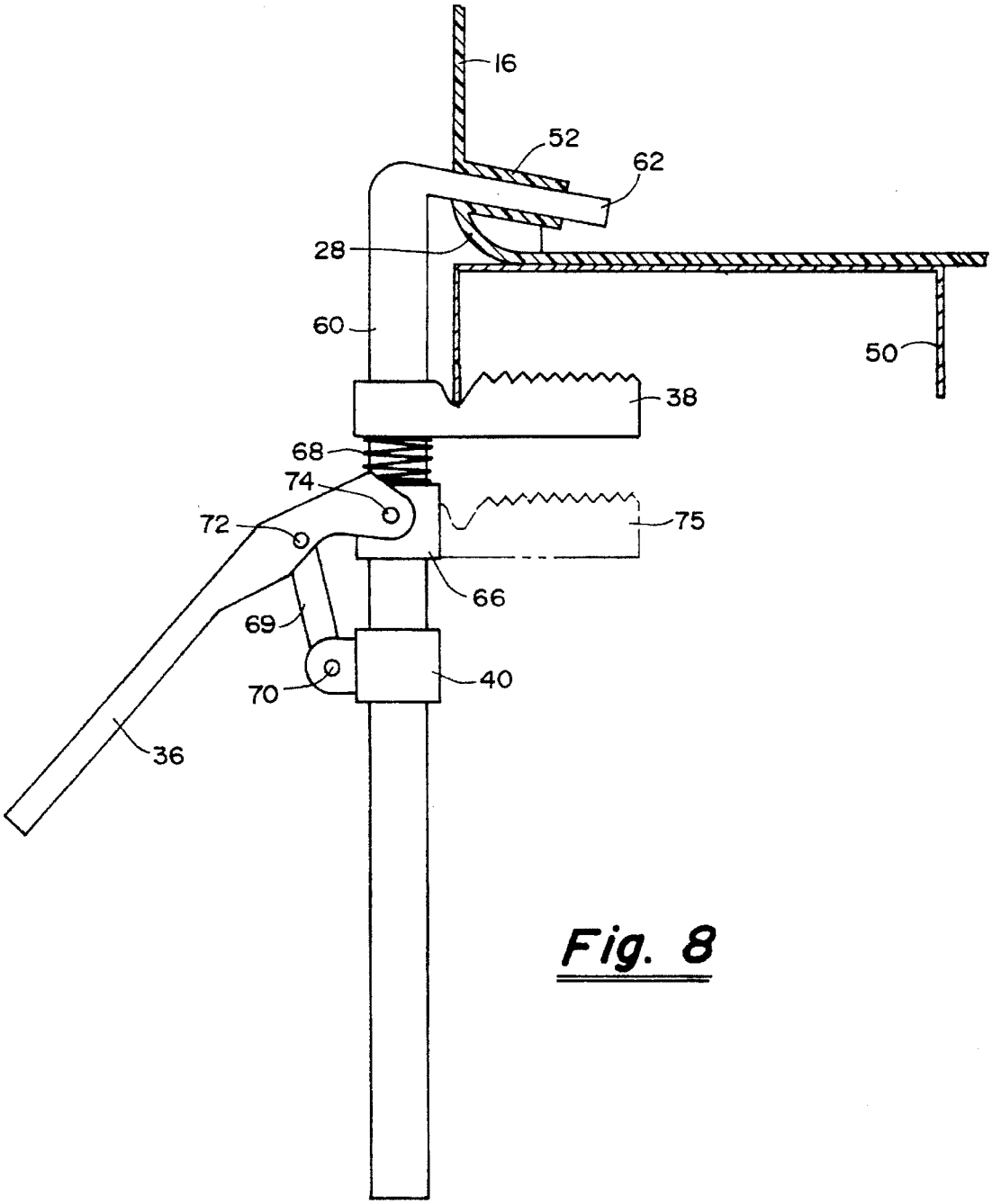
FIG. 8 is an enlarged partial section showing ladder clamp of FIG. 7 in an open position.

Now referring to FIG. 8 there is shown the clamp of FIG. 7 in an open position. The clamp is provided with a clamp push rod 69 which is hingedly attached to lower locking collar 40 by means of hinge pin 70 which is placed on the exterior of the collar away from the passage way provided through collar 40 to slideably receive clamp rod 60. Thus when pressure is exerted downwardly on clamp handle 36 to move the clamp to the closed position the location of hinge pin 70 causes the lower locking collar 40 to rotate the collar 40 into locking engagement with the clamp pipe 60. When the handle is moved to an open position, locking collar 40 is released to align with clamp pipe 60 permitting it to slide up and down to select various open positions for the lower clamp jaw 38 thereby permitting various sizes of materials to be clamped.

The handle 36 is provided with a hinge pin 72 at the opposite portion of the clamp push rod 69 to provide a leverage of the force applied to clamp handle 36 to permit very high compression forces to be obtained between clamp jaw 38 and the lower portion of the paint tray base 16 to engage a mount such as a ladder top therebetween. Shown in silhouette form is a alternate clamp jaw 75 extending from upper clamp collar 66. Manufacturing a upper collar 66 to include a clamp jaw 75 in this manner would not work very satisfactorily as such a clamp jaw would tend to cause upper collar 66 to rotate against clamp pipe 60 causing binding and an unworkable clamp arrangement. Preferably upper collar 66 should be separate from the clamp jaw 38 to avoid binding occurring when the clamp is being closed. As will be appreciated, the end of handle 36 is hingedly engaged to upper collar 66 by means of hinge pins 74 which are disposed on either side of collar 66 to permit the collar to slide freely along clamp pipe 60 when clamping occurs.

Figure 9:
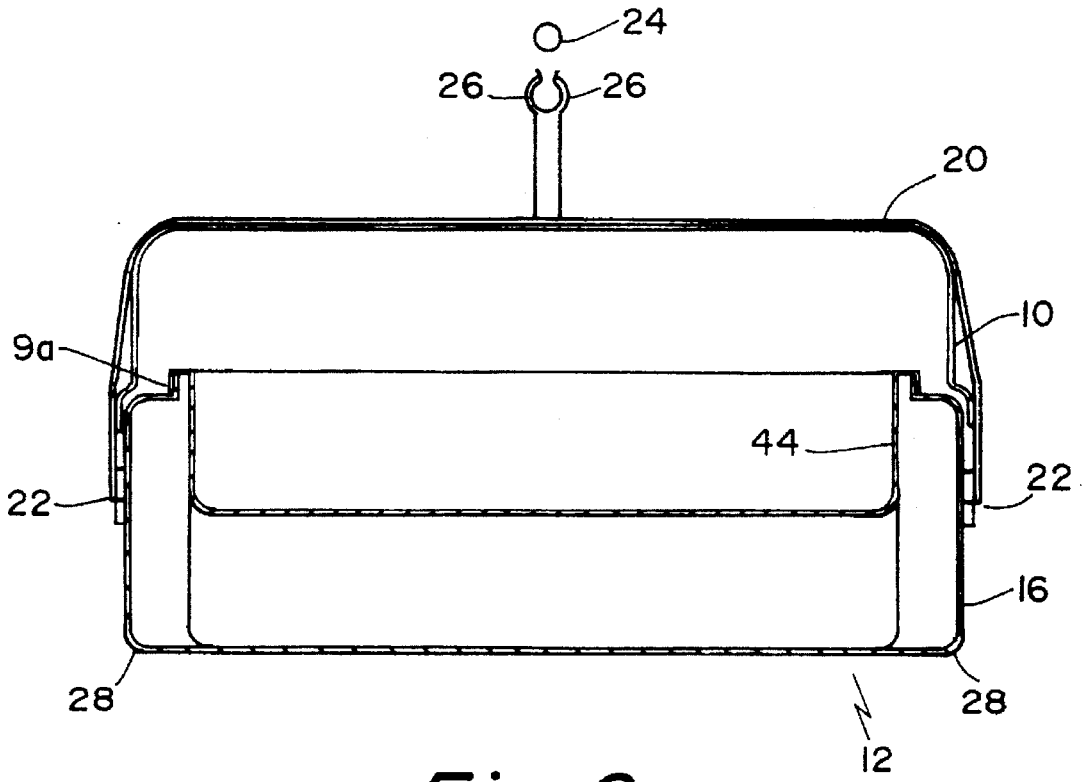
FIG. 9 is a cross section elevation view of paint tray of FIG. 1 including mounted carrying handle.
Figure 9A:
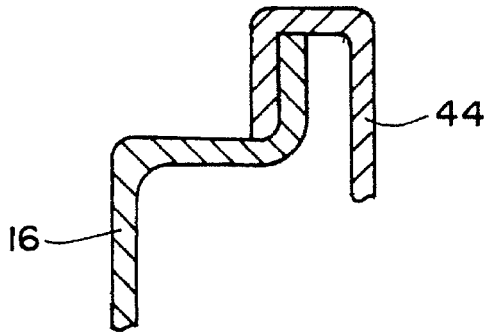
FIG. 9*a* Is an enlarged view of a portion of FIG. 9.

Now referring to FIG. 9 there is shown a cross sectional elevation view of the paint tray assembly of FIG. 2 including a carrying handle 20 mounted thereon. The paint tray assembly 12 includes a base 16 supporting the tray container 44 as was described with reference to FIG. 2. Provided on either side of the base 16 are handle engaging snaps 22 which are simply a loop and pivoting lever clasp such as is used in mechanics tool boxes, lunch pails and the like provided in base 16 to receive mating handle hooks 76 in the wire loop of the snaps 22. The interfitting surfaces between base 16 and tray container 44 are shown enlarged in FIG. 9*a*.

An end view shows the extension pole 24 receiving storage slot which is formed by parallel extending pole grips 26 extending from the upper portion of the hand grip of removeable handle 20. Also provided are the radiused corners 28 which permit the paint tray to more easily overcome debris or obstructions when being slid or dragged from one location to another over a flat surface.

Numerous enhancements in alternate mechanically equivalent constructions of the paint tray assembly described herein may occur to those skilled in the art and are intended to be included within the ambit of the invention as defined in the claims appended hereto.

I claim:

1. A paint tray assembly comprising a base having radiused corners extending around the bottom perimeter thereof, a paint holding container supported by said base and means for clamping said paint tray assembly to an object comprising:

(i) a clamp rod mountable in said paint tray assembly extending downwardly therefrom, (ii) a clamp jaw and a locking collar each slideably engaging said clamp rod (iii) a clamping handle pivotably engaging said clamp jaw, and (iv) locking means interposed between said clamping handle and said locking collar whereby closing said clamp handle will lock said locking collar to said clamp rod and cause said clamp jaw to compressably engage an object below said base.

2. A paint tray assembly as claimed in claim 1 wherein said tray includes at least one magnet whereby a paint brush may be magnetically retained by said tray.

3. A paint tray assembly as claimed in claim 1 including a rod rotatably affixed to the top of one side of said tray rotatable into a stand-by position extending along the side of said tray to which said rod is rotatably affixed and into a working position extending accross said tray to engageably rest on the other side of said paint tray.

4. A paint tray assembly as claimed in claim 3 including handle means removeably attachable to said paint tray assembly whereby said handle can be attached to said paint tray assembly to relocate said assembly.

5. A paint tray assembly as claimed in claim 1 including handle means removeably attachable to said paint tray assembly wherby said handle can be attached to said paint tray assembly to relocate said assembly.

* * * * *